US007287606B1

(12) United States Patent
Falgout, Sr.

(10) Patent No.: US 7,287,606 B1
(45) Date of Patent: Oct. 30, 2007

(54) DRILLING METHOD FOR ENLARGING A BOREHOLE USING A KICK SUB

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 258 days.

(21) Appl. No.: 11/080,096

(22) Filed: Mar. 14, 2005

(51) Int. Cl.
*E21B 7/04* (2006.01)

(52) U.S. Cl. ..... 175/61; 175/73

(58) Field of Classification Search ..... 175/61, 175/73, 74, 75, 76
See application file for complete search history.

(56) References Cited

U.S. PATENT DOCUMENTS 1,971,480 A * 8/1934 Earley ..... 175/61
2,025,261 A 5/1935 Zublin
2,345,766 A * 4/1944 Miller ..... 175/256
2,375,313 A * 5/1945 Miller ..... 175/243
2,402,238 A * 6/1946 Carpenter ..... 175/256
5,009,273 A * 4/1991 Grabinski ..... 175/61
5,495,900 A 3/1996 Falgout

* cited by examiner

*Primary Examiner*—William Neuder
*Assistant Examiner*—Nicole A Coy
(74) *Attorney, Agent, or Firm*—John D. Jeter

(57) ABSTRACT

A drill string is fitted at the lower end with a drill string deflecting apparatus and a drill bit. The drill string deflecting apparatus is activated to deflect the drill bit from the general center line of the drill string. Drilling proceeds to enlarge a length of larger well bore. The drill bit is lifted to allow the lower end of the drill string to move, by gravity, to the low side of the enlarged well bore. The drill string deflecting apparatus is straightened and drilling bit load is applied to drill ahead along the extended center line of the lower end of the drill string.

7 Claims, 2 Drawing Sheets

DRILLING METHOD FOR ENLARGING A BOREHOLE USING A KICK SUB

This invention relates to directional drilling control methods involving the use of a drill string deflecting apparatus to enlarge a progressing bore hole to provide space for a drill string to deflect by gravity to drill ahead along a deflected path.

BACKGROUND OF THE INVENTION

The usual use of drill string deflecting apparatus to change the direction of a progressing bore hole involves application of orienting means with well bore communication means to rotationally control the scribe line of the deflecting apparatus. Occasionally, well drilling does not require the use of down hole communication apparatus. On such occasions, however, it is necessary to prevent the unplanned drift of the related drill string from established limits from the vertical.

Modern drill string deflecting apparatus can be included in the bottom hole assembly with little effect upon the technical and economical burden on the drilling activity. Economical well bore survey equipment is normally essential to verify compliance with well bore deviation limits. When the survey work indicates that the well is approaching an excess drift from vertical, selected drill string deviation influencing apparatus, often called kick subs, can be activated by manipulation of the drilling fluid flow controls.

As commonly practiced, deflecting the well bore is accomplished by orienting the drill string relative to earth azimuth and drilling ahead along the original well gage. That method involves expensive well bore communication equipment. The well bore communication process is well established in the art but involves the drilling operation in a technically burdensome activity. A considerable amount of drilling takes place without the well bore communication activity.

By selectively situating stabilizers and exercising bit load controls, a large amount of footage is drilled while maintaining the well bore within limited deviation from vertical. That process normally sacrifices some penetration rate, and is an expensive process. There is a need for processes that sacrifices less penetration rate.

Modern drill string deflecting apparatus can remain in place in the bottom hole assembly without reducing penetration rate and with little technical burden on the drilling activity. Further, modern deflecting apparatus can be activated from the rig floor by manipulation of the drilling fluid flow rate controls, usually just the mud pump drive throttle controls.

Simple apparatus for use in confirming the deviation of the well bore from vertical has been in use for many years and is usually present on the drill site by regulation compliance needs.

If deviation from vertical, at a selected location, in the progressing well bore is small the bore straightening pendulum influence is slow to take effect and often requires reduced bit loads. The result is reduced penetration rate lasting for an extended period. Further, the required positioning of stabilizers for maximum pendulum influence often invites lateral influence of the drill bit caused by formation peculiarities.

The presence of deflecting apparatus near the drill bit, and the presence of well bore survey equipment makes possible a form of well bore control that is economical in terms of required equipment and loss of time.

The deflecting apparatus, once activated, will tend to enlarge the well bore as drilling progresses. Normally, the bit load can be maintained with little reduction of the penetration rate, after the deflecting apparatus has operated with reduced bit load for a short period of time. The well bore will initially be enlarged with reduced bit load, then the drill bit will walk around the available drilling face with increased bit load.

When sufficient enlarged length of bore is produced, the drill string can be lifted to allow the drill string pendulum effect to drop the bit to the low side of the enlarged hole. The kick sub can then be straightened to allow the bit to proceed along the changed extended axis of the lower end of the drill string. The progressing well bore then is drilled along a line with the departure from the vertical reduced relative to the previous well axis. When such practices are used, a substantial reduction in cost per foot of hole can be realized.

SUMMARY OF THE INVENTION

A drill string has a bottom hole assembly that includes a kick sub that can be activated by manipulation of the drilling fluid flow controls. The well survey apparatus, essential to drilling, is used to detect the need to reduce the departure of the progressing well bore from established limits. The kick sub is activated to cause enlargement of the continuing well bore. When a preselected length of enlarged well bore has been produced, the drill string is lifted to unload the bit. The lower end of the drill string, subject to gravity swings to the low side of the enlarged well bore. The kick sub is straightened and bit load is applied to continue drilling from the low side of the enlarged bore along a line nearer the vertical. No azimuthal orientation has been required and considerable time is saved. Costly and time consuming well bore communication apparatus has not been required.

These and other objects, advantages, and features of this invention will be apparent to those skilled in the art from a consideration of this specification, including the attached claims and appended drawings.

DETAILED DESCRIPTION OF DRAWINGS

It is defined, for use herein, that zero drilling fluid flow rate can be defined as a preselected flow rate.

Figure 1:
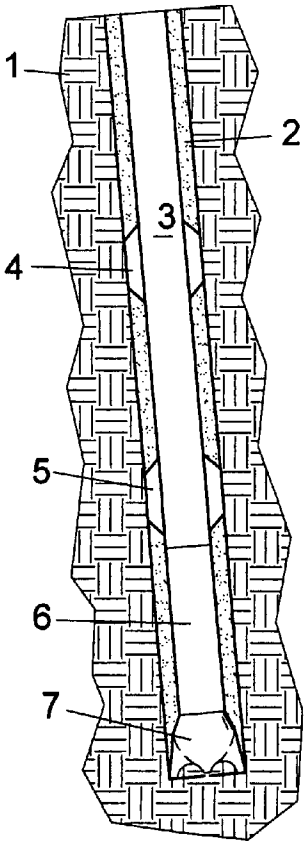
FIG. 1 is a side view of earth formation with a well bore containing a bottom hole drill string assembly.

FIG. 1 shows formation 1 with well bore 2, in which drill string 3 is suspended. The bottom hole assembly includes stabilizers 4 and 5, deflection apparatus 6 and drill bit 7. The well bore is deviated from vertical but the deflecting apparatus has not been activated. Under some conditions, the stabilizers are not necessary but they usually speed up the well bore correction process.

Figure 2:
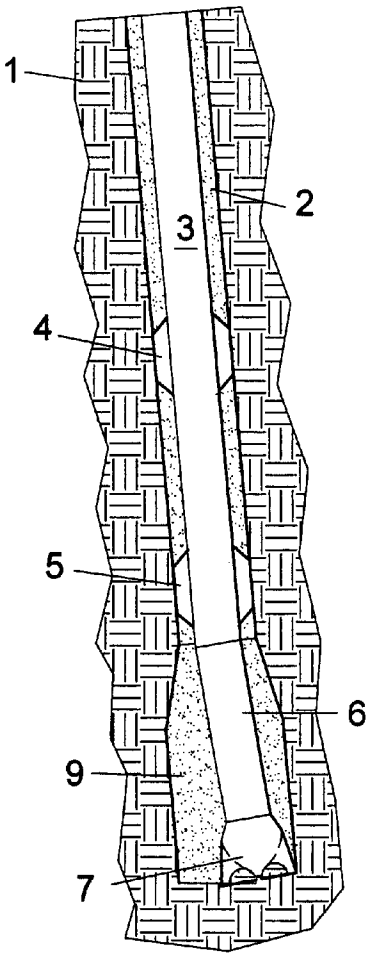
FIG. 2 is a side view, from the aspect of FIG. 1 with some enlarged hole drilled.

FIG. 2 shows a condition in which the deflecting apparatus has been activated, the drill string is rotating and bit load has been reduced to allow the lateral loads on the drill bit to enlarge the well bore 9 for some distance. After some distance drilled, the bit load can be increased.

Figure 3:
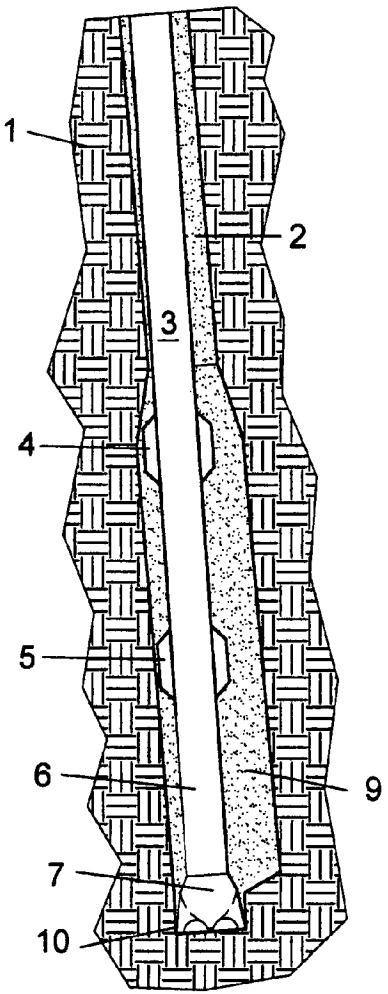
FIG. 3 is a side view, from the aspect of FIG. 2 with the drill string suspended in the enlarged well bore, and drilling ahead in the straight configuration.

FIG. 3 shows the enlarged bore 9 having proceeded for a preselected distance. The drill string has been lifted to allow the bottom hole assembly to move to the low side of the enlarged well bore. The deflecting apparatus has been straightened, and the well bore 10 is progressing ahead along the new deflected well bore center line.

Figure 4:
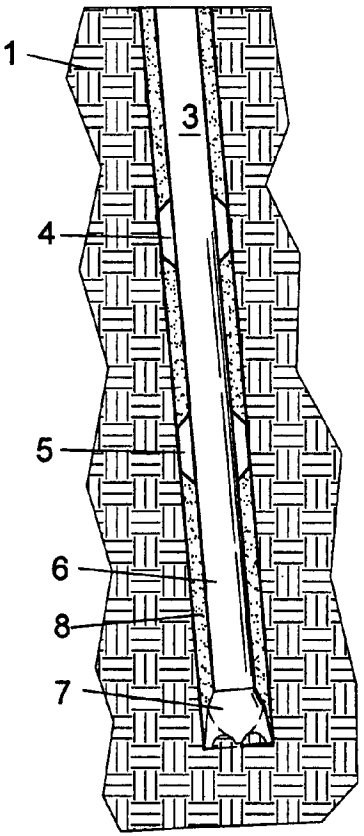
FIG. 4 is a side view from the aspect of FIG. 3 with the drill string progressing along the new extending well bore center line.

FIG. 4 shows the well bore progressing along a newly established center line with no burden on the drilling activity caused by the presence of the deflecting apparatus. The process can be re-activated in just minutes if further straightening of the well bore is indicated.

Figure 5:
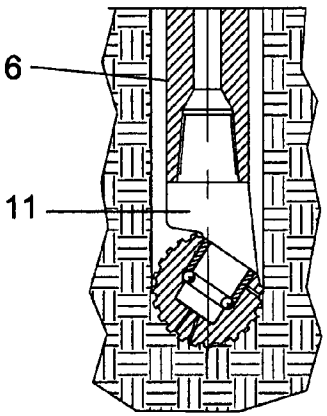
FIG. 5 shows an alternate bit type on the bottom hole assembly.

FIG. 5 shows an optional single cutter, nutating, drill bit 11 that has been found to offer advantages in well bore control in some formations.

DETAILED DESCRIPTION OF DRAWINGS

In FIG. 1 the well bore 2 is assumed to be approaching a limit to allowed departure from the planned well bore profile in formation 1. The drill string 3 with drill bit 7 has kick sub 6 situated below distributed stabilizers 4 and 5. The kick sub can be actuated to deflect by communication along the bore of the drill string. Ideally, only manipulation of the drilling fluid flow rate will cause the kick sub to deflect or to straighten selectively. Further, the ideal kick sub will indicate by pressure change detectable at the surface which mode of operation is active down hole.

FIG. 2 shows the well bore progressing with the kick sub actuated to deflect the bit from the original well bore center line. The well bore 9 has been enlarged to the extend the drill string stiffness permits.

FIG. 3 shows the drilling has continued until stabilizers 4 and 5 are in the enlarged well bore 9. The drill string has been lifted to allow the drill string to drop by gravity to the low side of the enlarged well bore. The kick sub has been straightened and bit load again applied. The new well bore 10 is progressing ahead with bit load applied.

FIG. 4 shows the drill string progressing ahead, along new bore 8, in normal drilling activity. The well bore deviation from vertical has been changed.

The well bore departure from vertical can be changed repeatedly without tripping the drill string.

From the foregoing, it will be seen that this invention is one well adapted to attain all of the ends and objects hereinabove set forth, together with other advantages which are obvious and which are inherent to the method.

It will be understood that certain features and sub-combinations are of utility and may be employed without reference to other features and sub-combinations. This is contemplated by and is within the scope of the claims.

As many possible embodiments may be made of the method of this invention without departing from the scope thereof, it is to be understood that all matter herein set forth or shown in the accompanying drawings is to be interpreted as illustrative and not in a limiting sense.

I claim:

1. A method for manipulation of a drill string, having a kick sub and a drill bit in the bottom hole assembly, to control deviation of a well bore from vertical, the method comprising:

a) activating a kick sub to deflect the lower end of the drill string;

b) rotating the drill string, with some bit load applied, to cause a drill bit to enlarge the progressing well bore;

c) drilling ahead until a preselected length of enlarged well bore has been produced;

d) lifting the drill string to unload the bit and to allow the lower end of the drill string to move, by gravity, to the lower side of the enlarged hole;

e) straightening the kick sub; and f) drilling ahead along the changed axis of the lower end of the drill string.

2. The method of claim 1 wherein the kick sub is deflected by manipulation of the rate of drilling fluid flow down the drill string bore.

3. The method of claim 2 wherein said activating of said kick sub is accomplished by increasing the drilling fluid flow rate from a first preselected flow rate to a second, higher, flow rate.

4. The method of claim 2 wherein said kick sub is changed to the straight configuration by reducing the drilling fluid flow rate from said second flow rate to a second preselected flow rate and increasing said flow rate to a higher third flow rate.

5. A method for manipulation of a drill string, having a drill bit and a drilling fluid flow rate activated kick sub in the bottom hole assembly, to control deviation of a well bore from vertical, the method comprising:

a) activating said kick sub to deflect the lower end of the drill string;

b) rotating the drill string, with some bit load applied, to cause a drill bit to enlarge the progressing well bore;

c) drilling ahead until a preselected length of enlarged well bore has been produced;

d) lifting the drill string to unload the bit and to allow the lower end of the drill string to move, by gravity, to the lower side of the enlarged hole;

e) straightening the kick sub; and f) drilling ahead along the changed axis of the lower end of the drill string.

6. A method for manipulation of a drill string, having a drill bit and a drilling fluid flow rate activated kick sub in the bottom hole assembly, to control deviation of a well a bore from vertical, the method comprising:

a) assembling a drill string with said kick sub and said drill bit in the bottom hole portion of the assembly;

b) activating said kick sub to deflect the lower end of the drill string;

c) rotating the drill string, with some bit load applied, to cause a drill bit to enlarge the progressing well bore;

d) drilling ahead until a preselected length of enlarged well bore has been produced;

e) lifting the drill string to unload the bit and to allow the lower end of the drill string to move, by gravity, to the lower side of the enlarged hole;

f) straightening the kick sub; and g) drilling ahead along the changed axis of the lower end of the drill string.

7. The method according to claim 6 wherein said drill bit is a single cutter bit having a nutating cutting structure.

* * * * *